US006250573B1

(12) United States Patent
Kriebel et al.

(10) Patent No.: US 6,250,573 B1
(45) Date of Patent: Jun. 26, 2001

(54) PROCESS AND DEVICE FOR THE DISPERSION OF A FIBROUS PAPER MATERIAL

(75) Inventors: Almut Kriebel; Volker Niggl, both of Weingarten; Josef Schneid, Vogt; Hans Schnell, Mengen; Wolfgang Mannes, Ravensburg-Bavendorg, all of (DE)

(73) Assignee: Voith Sulzer Papiertechnik Patent GmbH, Ravensburg (DE)

( * ) Notice: Subject to any disclaimer, the term of this patent is extended or adjusted under 35 U.S.C. 154(b) by 0 days.

(21) Appl. No.: 09/046,570

(22) Filed: Mar. 24, 1998

(30) Foreign Application Priority Data

Mar. 26, 1997 (DE) ..... 197 12 653

(51) Int. Cl.[7] ..... B02C 7/12
(52) U.S. Cl. ..... 241/17; 241/18
(58) Field of Search ..... 241/18, 17, 30

(56) References Cited

U.S. PATENT DOCUMENTS

| | | | | |
|---|---|---|---|---|
| 3,765,611 | * | 10/1973 | Steiniger | 241/18 |
| 3,765,613 | * | 10/1973 | Steiniger | 241/251 |
| 3,847,363 | * | 11/1974 | Reinhall | 241/245 |
| 3,910,505 | * | 10/1975 | Reinhall | 241/18 |
| 4,030,865 | * | 6/1977 | Kobayashi | 425/82 |
| 4,236,959 | * | 12/1980 | Reinhall | 162/23 |
| 4,270,552 | * | 6/1981 | Jenkins et al. | 131/290 |
| 4,283,252 | * | 8/1981 | Reinhall | 162/23 |
| 4,431,482 | * | 2/1984 | Heinbockel et al. | 162/243 |
| 4,676,440 | * | 6/1987 | Perkola | 241/261.3 |
| 4,909,900 | * | 3/1990 | Matzke et al. | 162/4 |
| 5,297,742 | * | 3/1994 | Grundiitz et al. | 241/20 |
| 5,478,441 | * | 12/1995 | Hamilton | 162/189 |
| 5,498,766 | * | 3/1996 | Stuart et al. | 435/99 |
| 5,518,580 | * | 5/1996 | Ortner et al. | 162/4 |
| 5,727,743 | * | 3/1998 | Schneid et al. | 241/261.3 |
| 5,730,376 | * | 3/1998 | Schneid et al. | 241/245 |

FOREIGN PATENT DOCUMENTS

| | | |
|---|---|---|
| 1806612 | 5/1970 | (DE) . |
| 19523704 | 1/1997 | (DE) . |
| 83/02788 | 8/1983 | (WO) . |
| 96/18769 | 6/1996 | (WO) . |

* cited by examiner

*Primary Examiner*—Allen M. Ostrager
*Assistant Examiner*—William Hong
(74) *Attorney, Agent, or Firm*—Greenblum & Bernstein, P.L.C.

(57) ABSTRACT

Process for dispersing a fibrous paper web which comprises a substantially consistent fibrous paper material. The process includes loosening and pulverizing a fibrous paper material into a fine, friable fibrous material; guiding the fine, friable fibrous material into a vapor chamber in which at least one of a gaseous and vaporous heating medium mixes, calefies, and disperses the fine, friable fibrous material; and dispersing the fine, friable fibrous material in a disperser zone, the disperser zone and the vapor chamber being located in one device. A device for dispersing a fibrous paper web which comprises a substantially consistent fibrous paper material. The device includes an inlet for fibrous paper material, a stationary stator, and at least one rotatable rotor. The stator and the at least one rotor form a pulverizing zone including a pulverizing element located near the inlet for the fibrous paper material, the pulverizing element including least one of scrapers and knives for pulverizing the fibrous material into a fine, friable material; a vapor chamber forming a ring about the pulverizing zone, the vapor chamber being for calefying the fine, friable material formed by the pulverizing element; and a dispersing zone including at least one row of teeth on the stator and at least one row of teeth on the at least one rotor which can be moved relative to the at least one row of teeth of the stator.

13 Claims, 2 Drawing Sheets

Fig. 1
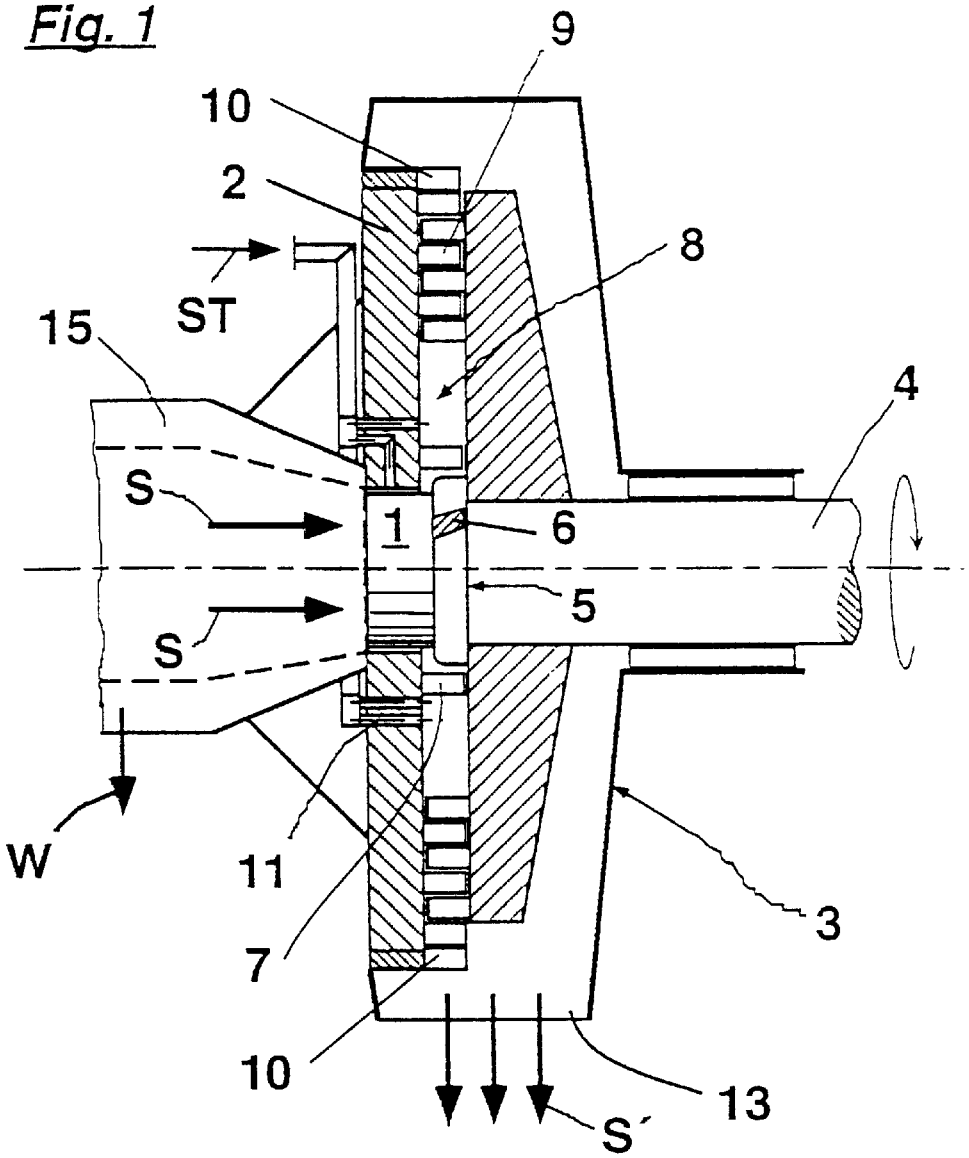
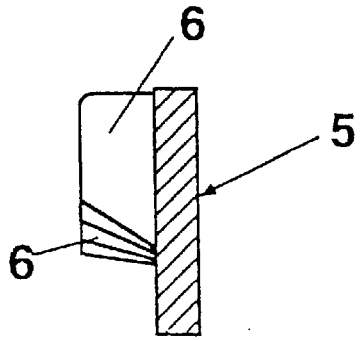
Fig. 2a
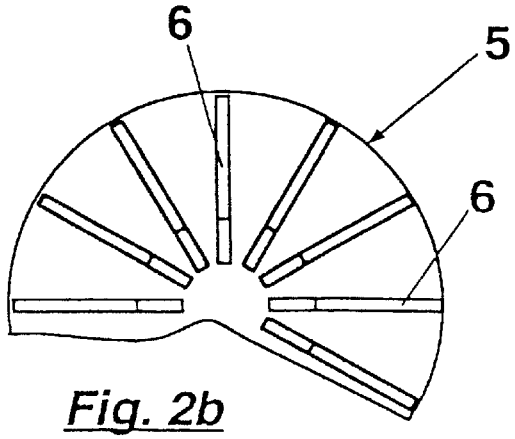
Fig. 2b

PROCESS AND DEVICE FOR THE DISPERSION OF A FIBROUS PAPER MATERIAL

CROSS-REFERENCE OF RELATED APPLICATION

The present invention claims the priority under 35 U.S.C. §119 of German Patent Application No. 197 12 653.7 filed on Mar. 26, 1997, the disclosure of which is expressly incorporated by reference herein in its entirety.

BACKGROUND OF THE INVENTION

1. Field of the Invention

The invention relates to a process and device for dispersing fibrous paper material.

2. Discussion of Background

Processes for dispersing fibrous paper material are, for example, necessary for the improvement of the quality of fibrous material, which is extracted from used paper. It is known that fibrous paper material can be homogenized and thereby significantly improved through dispersion. In many cases a fibrous material is used, which exhibits a dry content between about 15% and 35% and which has been brought to a temperature which is significantly above the ambient temperature. It is prudent to undertake the calefaction, i.e., warming, if the fibrous material already has the consistency necessary for dispersion. With this thickening process, a considerable portion of the water, which was previously still present in the fibrous material, is removed before calefaction. Through this process, first, its viscosity increases significantly in the dispersion and second, less water must be calefied. The most important machines for the thickening are worm presses and sieve presses.

With a sieve press, the fibrous material suspension is fed in between a sieve and a roll or between two sieves and pressed, so that the water is discharged. As a result, a moist fibrous material web is formed. Depending upon the operational parameters, this web has a solid matter G.S.M. between about 500 g/m$^2$ and 2000 g/m$^2$. Pressures which deviate from this range, however, can also be advantageous. The moist web is taken from the area of the sieve or the sieves and must, thereafter, be torn into flat pieces. These pieces are easy to calefy to the desired temperature, but a relatively long calefaction period is necessary. Thus, calefaction periods of, for example, several minutes must be accepted, especially if a temperature above 90° C. is desired. Thereafter, the hot, friable material is fed into a disperser. The entire process requires a device that is quite expensive.

With a worm press, the fibrous material suspension is pressed between a worm conveyer and a perforated jacket surrounding it, whereby the water leaves through the jacket. The resulting pressed pulp, or plug, is pressed from the worm and breaks into pieces. Only a relatively long calefaction period can bring these pieces to the desired temperature. A further pulverization can, for example, occur in a pulverizing worm or in a system with counter-rotating rotors, which is, however, very expensive.

SUMMARY OF THE INVENTION

It is therefore a task of the present invention to create a process in which it is possible to shorten the calefaction periods and at the same time to reduce the industrial construction expenses and spatial requirements.

More specifically, the present invention involves a process for dispersing a fibrous paper web which comprises a highly consistent fibrous paper material. The process includes loosening and pulverizing a fibrous paper material into a fine, friable fibrous material; guiding the fine, friable fibrous material into a vapor chamber in which at least one of a gaseous and vaporous heating medium mixes, calefies, and disperses the fine, friable fibrous material; and dispersing the fine, friable fibrous material in a disperser zone, the disperser zone and the vapor chamber being located in one device.

Using this process it is possible to manufacture at low cost a friable material that is sufficiently fine and can be calefied at a correspondingly quick rate. Further, according to the present invention, industrial expenditure is relatively low, since the processes of pulverization, calefaction, and dispersion can be executed in a single device.

The high-consistency fibrous paper material can either be admitted directly into the mounting of a disperser as a plug or in the form of a loose, just preliminarily crushed, high-consistency material. The material is then taken up by the first pulverization step of the disperser and pulverized and fluidized, whereby the fine, friable fibrous materials arise. By supplying vapor into the zone which succeeds the first pulverization stage downstream, the material is then calefled to the necessary temperature, whereby a relatively short calefaction period is sufficient, due to the previous, intensive pulverization. The actual dispersion, that is, alteration of material characteristics, occurs in the dispersion zone, which follows downstream.

In one aspect, the present invention involves a process for dispersing a fibrous paper web which comprises a substantially consistent fibrous paper material. The process includes loosening and pulverizing a fibrous paper material into a fine, friable fibrous material; guiding the fine, friable fibrous material into a vapor chamber in which at least one of a gaseous and vaporous heating medium mixes, calefies, and disperses the fine, friable fibrous material; and dispersing the fine, friable fibrous material in a disperser zone, the disperser zone and the vapor chamber being located in one device.

In accordance with an aspect of the invention, the loosening, pulverizing, calefying, and dispersing may occur between a stator and a rotor of a disperser, wherein the stator and rotor comprise concentric rows of teeth which extend axially into a chamber between the stator and rotor.

In accordance with another aspect of the invention, the fine, friable fibrous material has a maximum thickness of about 5 mm. The fine, friable fibrous material may have a maximum length of about 10 mm.

In accordance with yet another aspect, the fine, friable fibrous material is spun in the heating medium and is in a fluidized state at least during a predominant portion of calefaction. A mean duration of time of the fine, friable fibrous material in the vapor chamber may be between about 0.5 and 3 seconds. The heating medium may be superheated vapor which is supplied to a radially exterior area of the vapor chamber. The heating medium may be superheated vapor which is supplied to a radially interior area of the vapor chamber. Installations may be provided in the vapor chamber to retard movement of the fine, friable fibrous material in the vapor chamber.

In accordance with an aspect of the invention, radial movement of the fine, friable fibrous material in the disperser zone is throttled.

In accordance with another aspect of the invention, a maximum velocity of an instrument triggering the pulverizing step is between about 10 m/s and 30 m/s.

In accordance with yet another aspect of the invention, the pulverizing involves a pulverizing element which immediately engages a material plug which has left a draining worm. The pulverizing may involve a pulverizing element which engages fibrous pulp pieces from pre-pulverization of a moist fibrous pulp web that has run off a sieve press.

In accordance with an aspect of the invention, the process further comprises calefying the fibrous paper material before the pulverizing.

In another aspect, the present invention involves a device for dispersing a fibrous paper web which comprises a substantially consistent fibrous paper material, including an inlet for fibrous paper material; a stationary stator; at least one rotatable rotor; and wherein the stator and the at least one rotor form: a pulverizing zone including a pulverizing element located near the inlet for the fibrous paper material, the pulverizing element comprising at least one of scrapers and knives for pulverizing the fibrous material into a fine, friable material; a vapor chamber forming a ring about the pulverizing zone, the vapor chamber being for calefying the fine, friable material formed by the pulverizing element; and a dispersing zone including at least one row of teeth on the stator and at least one row of teeth on the at least one rotor which can be moved relative to the at least one row of teeth of the stator.

In accordance with one aspect, the at least one row of teeth of the stator and the at least one row of teeth of the at least one rotor form a gap of up to about 3 mm. The vapor chamber may be delimited downstream by a row of stator teeth which extend to form a gap with rotor teeth of up to about 3 mm. The stator teeth may have a distance of at least 50 mm in peripheral direction. The vapor chamber being delimited downstream by a row of rotor teeth which extend to form a gap with the stator of up to about 3 mm.

In another aspect of the invention, the vapor chamber is connected to a vapor supply line via a vapor pipe.

In yet another aspect of the invention, the disperser zone is closed off radially outside by a throttle, which renders a valve opening area adjustable. The throttle may comprise a throttle ring equipped with openings, wherein the throttle ring is capable of being turned to adjust the valve opening area The throttle comprises a throttle ring, wherein the throttle ring is capable of being axially displaced to adjust the valve opening area.

In another aspect, the present invention involves a process for dispersing a fibrous paper web, comprising in one apparatus: pulverizing a fibrous paper material into a fine, friable fibrous material; mixing, calefying, and dispersing the fine, friable fibrous material in a vapor chamber by using at least one of a gaseous and vaporous heating medium; and dispersing the fine, friable fibrous material in a disperser zone.

In still another aspect, the present invention involves a device for dispersing a fibrous paper web, comprising: an inlet for fibrous paper material; a stator surrounding the inlet, the stator including at least one row of teeth; a rotor having at least one row of teeth which cooperates with the at least one row of teeth of the stator, the rotor including a pulverizing element adjacent to the inlet, the pulverizing element comprising at least one of scrapers and knives for pulverizing the fibrous material into a fine, friable material; and a vapor chamber formed between the rotor and stator for calefying the fine, friable material formed by the pulverizing element.

BRIEF DESCRIPTION OF THE DRAWINGS

The present invention is further described in the detailed description which follows, in reference to the noted plurality of non-limiting drawings. Shown are:

FIG. 1 a partial cross-sectional view showing the basic procedural steps, using a disperser designed in accordance with the present invention;

FIG. 2*a* a cross-sectional view of a pulverization element;

FIG. 2*b* a side elevational view of the pulverization element of FIG. 2*a;*

DETAILED DESCRIPTION

Figure 3:
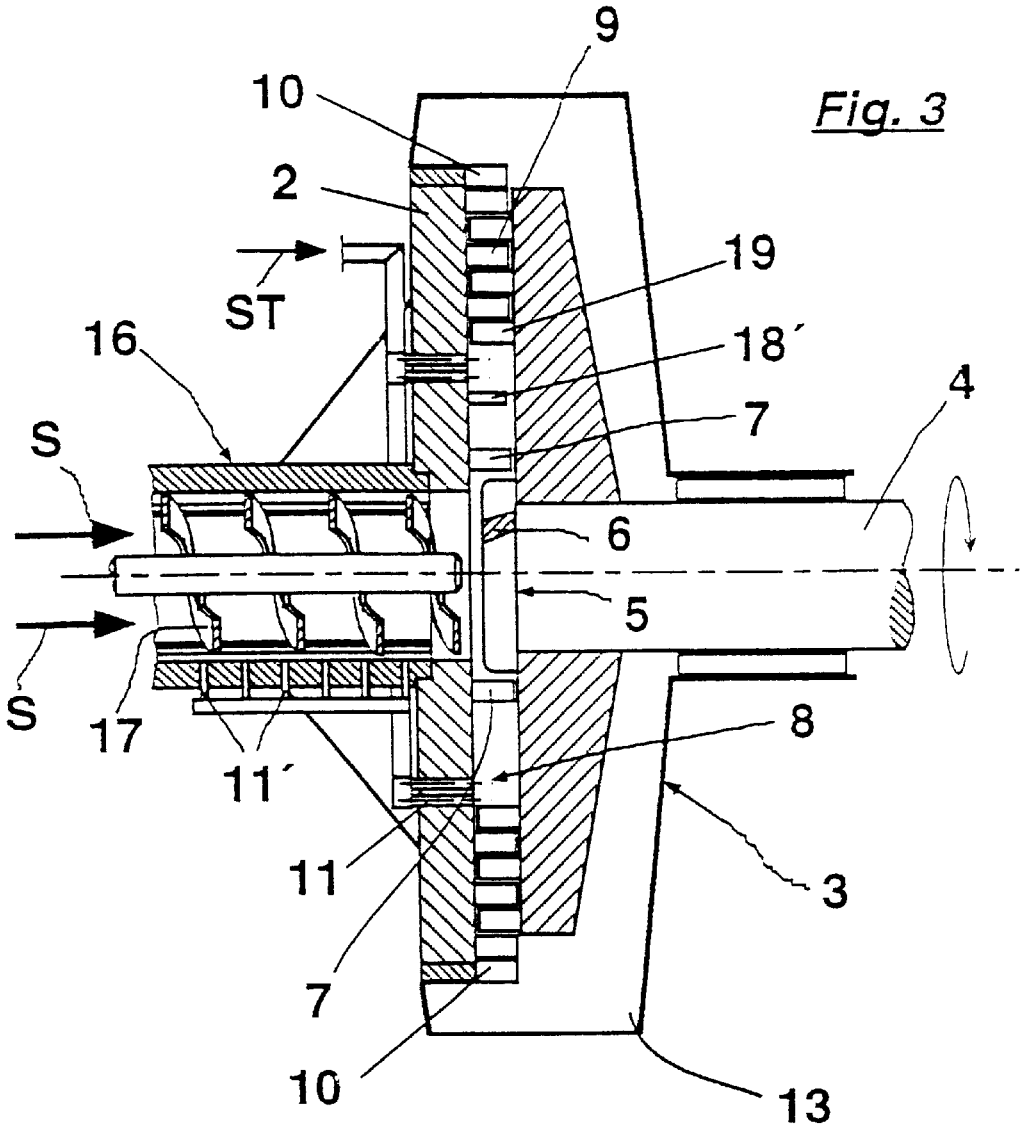
FIG. 3 a cross-sectional view showing another embodiment having a modified material supply line and a modified vapor chamber.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show details of the invention in more detail than is necessary for a fundamental understanding of the invention, the description making apparent to those skilled in the art how the several forms of the invention may be embodied in practice.

FIG. 1 shows the process of the present invention, using a device to be used for the process. In this process, the high-consistency fibrous paper material S is pressed as plugs 1, coming from a thickening press 15, directly in the area of a disperser 3. The disperser 3 has a radial material flow, and includes a stator 2 and a rotor 4. The maximum peripheral velocity of the rotor 4 is between about 10 and 30 m/s. Alternatively, the disperser may be an axial disperser or kneading machine.

The disperser 3 shown in FIG. 1 is loaded radially inwards, to which an initial pulverizing element 5 is mounted in the center of the rotor 4. The pulverizing element 5 can bear, for example wing-shaped or cross-shaped pulverizing strips 6. The plug 1 which is pressed against the pulverizing element 5 is stripped away or rasped and thereby divided into fine friable material, which is not shown in FIG. 1.

Primary stator teeth 7 retard the material and thereby extend its duration in the vapor chamber 8, which follows outside radially. In this regard, the mean duration of time of the fine, friable fibrous material in the vapor chamber 8 is between about 0.5 and 3 seconds.

Through the impact of the fibrous material, which is thrown about by the pulverizing element 5, it is pulverized farther. A pulverization down to speck-size is advantageous, in order to keep the calefaction period low. In accordance with the present invention, the fine, friable fibrous material has a maximum thickness of about 5 mm, and has a maximum length of about 10 mm.

The vapor chamber 8 of the embodiment of FIG. 1 is essentially ring-shaped and does not have any teeth for mechanical dispersion. Dispersion is caused by teeth that are moved past one another at a relatively high rate of speed. When teeth are moved past one another at a relatively high rate, the fibrous material between the teeth is subjected to high shearing forces.

The purpose of the disperser zone 9, which follows radially farther outside of the vapor chamber 8, is to disperse the paper material by means of teeth. There, high peripheral velocities of the disperser teeth are then possible and advantageous, while the pulverizing strips 6 lying radially farther inward are slower and thus pulverize the arriving plugs 1 more gently. The teeth of the stator and the teeth of the stator may form rows which form a gap of up to about 3 mm. The stator teeth may extend to form a gap of up to about 3 mm between the stator teeth and the rotor.

Within the vapor chamber 8, the material is thus not mechanically dispersed. If necessary, however, installations 18 (FIG. 4) can be present in the vapor chamber 8, which slow down the movement of the circulating material and which loosen the material, as described in more detail below. Supplied superheated vapor ST, which could be supplied at temperature such as about 130° C. and the corresponding vapor pressure, is brought into contact with the fibrous material in the vapor chamber 8 via the vapor pipe 11. It is thereby fluidized or at least loosened in the vapor chamber 8, so that it can be penetrated thoroughly by the vapor. The calefaction can be attained essentially by the condensation of the vapor, that is, the vapor is constantly resupplied. The resupply improves the fluidizing and the loosening of the friable fibrous material. After the dispersion, the dispersed fibrous material S' falls through the outlet 13.

Through the plug 1 and the material in the disperser zone 9, the vapor chamber 8 is essentially sealed from the external world. It is also advantageous if the disperser zone 9 is closed off by a throttle ring 10, since the fill-level of the apparatus can be regulated therewith. In accordance with the invention, a higher and more uniform fill-level in the disperser zone 9 is especially advantageous because otherwise the outer diameter of the disperser apparatus would have to be designed to be very large, in order to treat the fibrous material in the desired manner. Such a throttle ring is, for example, known from DE 195 23 704 A1, the disclosure of which is herein incorporated by reference in its entirety.

In summary, a high effect results in a small space with the method of the present invention, which is why very compact devices are possible. The size of the vapor chamber 8 must, of course, be fixed such that the friable material has sufficient dwelling time for heating. Depending upon the size of the friable material, about 1 to 2 seconds duration suffices. This time depends upon the targeted temperature and upon the fineness of the friable material.

FIG. 2*a* and 2*b* show a possible embodiment of the pulverizing element 5 in side-view (FIG. 2*a*) or top-view (FIG. 2*b*). FIGS. 2*a* and 2*b* show the radially directed pulverizing strips 6. The effectiveness of the pulverizing strips meets the required pulverizing task, and fiber damaging is avoided as much as possible, in particular with fibers which are still cold. The pulverizing strips 6 have, however, the task to loosen and to fluidize the fine, friable material that is created.

FIG. 3 shows another solution in accordance with the present invention with the major difference that the high-consistency fibrous paper material is not admitted into the dispersion device as compacted plugs, but rather pre-pulverized in a more or less loose form. Such a previously pulverized material arises, for example, if the thickening occurs on a sieve press, from which the thickened fibrous paper material is known to exit as a moist web. Through subsequent pulverization, for example, in a pulverization worm, the material is made small enough in advance, so that it is transportable in worm systems. The pre-pulverized material is then taken up by a supply worm 16 before the entry into the disperser 3 and then immediately led into the central inlet of the disperser 3, as is illustrated in FIG. 3. This supply worm 16 can have a plugging effect, but this is not necessary in order to execute the process in accordance with the invention. Rather, the supply worm 16 can alternatively be designed as a belt worm, which demonstrates a helical belt 17 only on its outer diameter and conveys at a comparable rate. It is advantageous that the material can already be pre-heated in it, a process which is possibly served by available vapor lines 11'. Then the pulverizing step is gentler on the fibers and the later calefaction to the disperser temperature goes more quickly. If the material is introduced into the central inlet of the disperser 3 in a relatively loose state, it does not offer the stability of a solid plug, as is shown in FIG. 1. The fine pulverization is possible, however, since the material has a lower radial velocity than the pulverizing strips 6, which are mounted on the pulverizing element 5. Often, the primary stator teeth 7, beyond their retarding effect, can improve the pulverization.

In the embodiment depicted in FIG. 3, the supply of the superheated vapor ST occurs on the radially exterior edge of the vapor chamber 8 in contrast with the embodiment of FIG. 1. A reverse current calefaction should be attained therewith, assuming a corresponding centrifugal field in the vapor chamber 8. Depending upon the amount of vapor supplied and condensed, the vapor supplementally fluidizes the friable material in the vapor chamber. Similar considerations regarding the optimal vapor supply areas are also to be employed with other embodiments, for example, the embodiment of FIG. 1.

Figure 4:
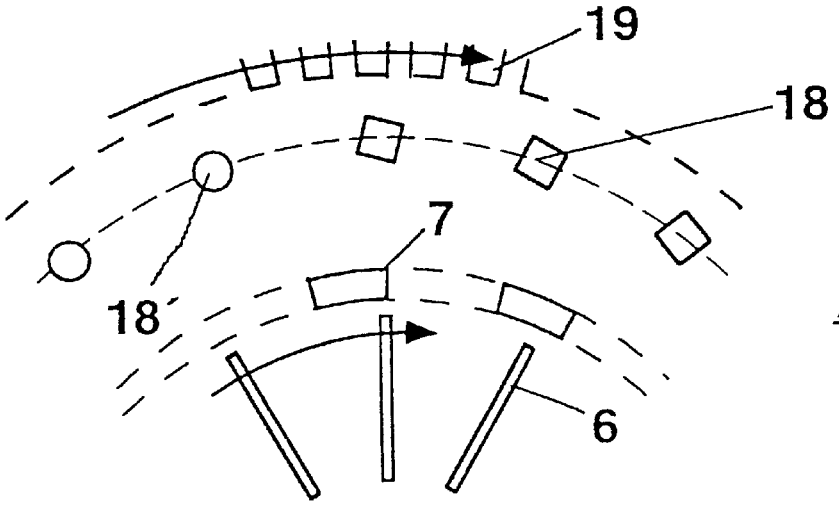
FIG. 4 a top view schematic of part of the vapor chamber of FIG. 4.

In order to guarantee a sufficient loosening of the fine friable fibrous material in the vapor chamber 8, further installations can be provided in this area, which have a retarding and/or loosening effect on the fibrous material. Examples of such installations include small pins or blades, which are to be designed such that they do not make the volume in the vapor chamber 8 significantly smaller. Feasible installations 18 and 18' are shown in FIG. 4, which installations are anchored on the stator 2. Such installations 18, 18' can be round pins, rounded-off pins, pins fitted with rebound edges, or small blades.

It is important that the fine friable material in the vapor chamber is sufficiently loose, in order to allow the superheated vapor to reach all free surfaces.

The inner row of the disperser teeth 19 illustrated here belongs to the rotor 2. The material reaches between these disperser teeth 19 and is pressed through the disperser zone 9. In other cases, it can be advantageous to close the vapor chamber 8 radially outwards via a row of teeth belonging to the stator.

It is noted that the foregoing examples have been provided merely for the purpose of explanation and are in no way to be construed as limiting of the present invention. While the invention has been described with reference to preferred embodiments, it is understood that the words which have been used herein are words of description and illustration, rather than words of limitation. Changes may be made, within the purview of the appended claims, as presently stated and as amended, without departing from the scope and the spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A process for dispersing a fibrous paper stock which comprises a substantially consistent fibrous paper composition, comprising:

loosening and pulverzing a wet fibrous paper composition into a fine, friable fibrous composition;

introducing the fine, friable fibrous composition into a vapor chamber;

introducing into said vapor chamber, separately from said fibrous composition, at least one of a gaseous and vaporous heating medium which mixes, and raises a temperature of the fine, friable fibrous composition;

dispersing the fine, friable fibrous composition in a disperser zone, the disperser zone and the vapor chamber being located in one device; and triggering said pulvenzing with a maximum velocity between about 10 m/s and 30 m/s.

2. The process of claim 1, wherein the loosening, pulverizing, calefying, and dispersing occur between a stator and a rotor of a disperser, and wherein the stator and rotor comprise concentric rows of teeth which extend axially therefrom into the vapor chamber between the stator and rotor.

3. The process of claim 1, wherein said loosening and pulverizing comprises loosening and pulverizing the fine, friable fibrous composition to a maximum thickness of about 5 mm.

4. The process of claim 1, wherein said loosening and pulverizing comprises loosening and pulverizing the fine, friable fibrous composition to a maximum length of about 10 mm.

5. The process of claim 1, comprising spinning the fine, friable fibrous composition in the heating medium in a fluidized state at least during a predominant portion of calefaction.

6. The process of claim 1, further comprising keeping said fine friable fibrous composition in the vapor chamber for a mean duration of time between about 0.5 and 3 seconds.

7. The process of claim 1, further comprising supplying the heating medium, which is superheated vapor, to a radially exterior area of the vapor chamber.

8. The process of claim 1, further comprising supplying the heating medium, which is superheated vapors to a radially interior area of the vapor chamber.

9. The process of claim 1, further comprising retarding movement of the fine, friable fibrous material in the vapor chamber.

10. The process of claim 1, comprising throttling radial movement of the fine, friable fibrous composition in the disperser zone.

11. The process of claim 1, further comprising calefying the fibrous paper composition before the pulverizing.

12. The process of claim 1, wherein the pulverizing comprises engaging a material plug, which has left a draining worm, with a pulverizing element.

13. The process of claim 1, wherein the pulverizing comprises engaging fibrous pulp pieces from pre-pulverization of a moist fibrous pulp web, that has run off a sieve press, with a pulverizing element.

* * * * *